United States Patent [19]

Harrison

[11] Patent Number: 4,917,748

[45] Date of Patent: Apr. 17, 1990

[54] METHOD OF MAKING MICROWAVE HEATABLE MATERIALS

[75] Inventor: Peter Harrison, West Yorkshire, England

[73] Assignee: Waddingtons Cartons Limited, Leeds, United Kingdom

[21] Appl. No.: 145,359

[22] Filed: Jan. 19, 1988

[30] Foreign Application Priority Data

Jan. 17, 1987 [GB] United Kingdom ..... 8700966

[51] Int. Cl.[4] ..... B32B 31/20

[52] U.S. Cl. ..... 156/230; 156/242; 156/277; 219/10.55 E; 427/198; 427/243; 427/407.1

[58] Field of Search ..... 426/107, 109, 113, 127, 426/124, 234, 241, 243; 156/77–79, 230, 242–243, 245, 252, 253, 268, 274.4, 276, 272.2, 277, 155, 233, 240, 239, 235, 289; 428/344, 209; 427/198, 243, 401.1; 219/10.55 E

[56] References Cited

U.S. PATENT DOCUMENTS

| | | | |
|---|---|---|---|
| 4,434,197 | 2/1984 | Petriello | 426/243 |
| 4,662,969 | 5/1987 | Wang | 156/272.4 |
| 4,676,857 | 6/1987 | Scharr | 156/240 |
| 4,735,513 | 4/1988 | Watkins | 426/113 |
| 4,833,007 | 5/1989 | Huang . | |

FOREIGN PATENT DOCUMENTS

| | | |
|---|---|---|
| 0242952 | 10/1987 | European Pat. Off. . |
| 2035843 | 6/1980 | United Kingdom . |

*Primary Examiner*—Merrell C. Cashion, Jr.
*Attorney, Agent, or Firm*—Klauber & Jackson

[57] ABSTRACT

The invention provides that receptor films for use in microwave ovens for the browning and crisping of foodstuff are created by forming a composition which is liquid in nature and contains interactive particles. The composition is laid down in order to form a film which is then dried in order to fix the interactive particles in distributed form so that they will behave as an interactive layer when subjected to microwave radiation. It is suggested that the interactive particle layer should be covered by a protective layer such as heat curable varnish in order to isolate the particles from the foodstuff which will be adjacent thereto to be crisped and browned thereby. The composition comprises a cross linking and heat resistant resin acting as a binder so that when the composition is applied on a receiving surface, it is cured for example by subjecting it to heat to fix the particles in distributed condition.

31 Claims, No Drawings

METHOD OF MAKING MICROWAVE HEATABLE MATERIALS

This invention relates to heat receptor (or microwave interactive) materials of the type used in microwave cooking.

A known heat receptor material comprises typically a vacuum metalised film which is placed adjacent and frequently in contact with foodstuff which is being cooked by microwave energy, and because such film contains metalised particles, when it is subjected to microwave energy it heats up to a significant degree. An example of such receptor material is disclosed in United Kingdom Pat. No. 2,046,060B which discloses the use of a metal layer vacuum metalised on a synthetic plastic film. IT is stated that the thickness of the metal layer can vary within limits but it has been generally found that metal layers having surface resistance which varies between .4 and 8 ohms per sq. in. offer satisfactory results. The thickness of the metal is not directly measurable by mechanical means, but appropriate calculations indicate the metal layer would be equivalent to a film of aluminium having a thickness of between 200 and 300 angstroms if the resistance was of the order of 1.5 ohms per sq. in. For a metal layer of conductive particles having a surface resistance of between .4 and 8 ohms per sq. m. the thickness would be likely to vary between approximately 700 and 40 angstroms. It is also stated that the upper thickness of a quantity of metal in the layer is not readily determinable using commercially available products.

For example, it is stated that the thinnest commercially available film or foil of aluminum which is pin hole free has a thickness of approximately 0.00025 in., which corresponds to approximately 65,000 angstroms. Experiments have shown that such a thickness is too great to allow the foil to heat up upon exposure to microwaves. The gap between the thinnest commercially available foil i.e. the 0.00025 in. foil and vacuum vapour deposited films is stated in said British Patent to be about two orders of magnitude but tests have shown that the orders of magnitude are much greater e.g. of the order of 1000 and there are no materials between these thicknesses. Some metal films may prove functional at some thicknesses greater than as described in the said British Patent Specification, the criterion being that the metal layer must be of such thinness as to be readily and rapidly heated upon exposure thereto by microwave radiation which means that the heating must occur within a sufficient amount of time to reach a sufficient temperature so as to be capable of browning the exterior of the food during the normal cooking time of such foods in a microwave oven and an example is given that a vacuum vapour deposited metal layer having a surface resistance of approximately 2 ohms per sq. in. is capable of achieving a temperature in excess of 200°C., within 30 seconds, and a similar layer having a surface resistance approximately equalling 4 ohms per sq. in. will achieve a temperature exceeding 200°C. in a time period between 20 and 30 seconds.

The present invention is also concerned with the creation of receptor material including microwave interactive particles deposited in layers not only of thicknesses generally of the same range a disclosed in the said British Patent but also in layers of greater thicknesses, all for the purpose of creating a layer which will heat up when subjected to microwave radiation as described in said British Patent.

Typical utilisations of receptor materials in microwave cooking are outlined in the following U.S. Pat. Nos.

4,555,605
4,590,249
4,592,914
4,553,010

Vacuum metalised films are expensive, and because they are fabricated separately from, for example, the usual packaging materials used in foodstuffs such as paper, paper board and plastic foils, expense and time must inevitably be expended to produce composite packaging containers embodying the substrate material of the container, and the vacuum metalised receptor film.

It is also known from U.K. Patent Specification No. 2035843A to apply coatings on insulating bodies to produce conductors thereon, the coatings containing conductive particles for this purpose, but such coating method is for the manufacture of relatively large bodies, for example for the manufacture of heating elements for the heating of premises, or for screening panels or ariel dishes or the like.

The present invention concerns an improved method for producing a microwave interactive material, which may typically be used for or in a packaging container.

According to the present invention there is provided a method for producing a microwave interactive material comprising the steps of:

(a) providing a receiving surface;

(b) applying to the receiving surface a composition comprising a liquid component in which are distributed microwave interactive particles so as to distribute the particles over the receiving surface;

(c) drying the liquid component of the composition to leave the particles so distributed to fix the particles in such distribution to ensure that the particles form a layer which heats up when subjected to microwave radiation.

The receiving surface preferably comprises a sheet of cardboard material or a synthetic plastics material sheet or film.

Specifically the receiving surface may comprise a surface or part of the surface of a receptacle which is for containing foodstuff to be cooked in a microwave oven, the arrangement being that when the receptacle contains the foodstuff, such foodstuff is adjacent said receiving surface. By this means foodstuff may be marketed in packages already provided with the receptor material, and the user simply places the entire package in a microwave oven when the foodstuff is to be cooked. By virtue of the receptor material being adjacent the foodstuff, that portion of the foodstuff in contact with the receptor material will be subjected to a high temperature e.g. up to and of the order of 200°C. or more so that the surface of the foodstuff will be browned or crisped, the remainder of the foodstuff being cooked by normal microwave cooking.

Preferably, the composition is stirred prior to application of same to the receiving surface in order to ensure that the particles are evenly distributed throughout the liquid component. It is preferred that a printing step be used for applying the composition and the printing step may be any suitable such as gravure, roller coating, litho, letter press or screen printing, and the composition may be laid down in a single pass or in several passes. In a preferred arrangement, the liquid component or a major part of same comprises a cross-linking synthetic resin which acts as a binder for binding the particles in the distributed condition when the resin has been cured.

In one example, the liquid composition is made up of two parts, namely a first part and a second part, the first part comprising the microwave interactive particles suspended in water, and the other part comprising a mixture of water and the binding material such as an acrylic, silicone or other non-heat degrading binding material of the type normally used for ink binding functions.

In a particular example of such composition, the first part is mixed with the second part in the ratio of 24 to 20 by weight, and of the first part, this may contain 30% of microwave interactive particles, typically of graphite, whilst the second part may be a mixture of the acrylic binder and water, the acrylic binder being present in an amount equal to 45% of the total.

In the composition which is applied by printing, said interactive particles may be contained therein in proportions of from one ninth up to one half of the total composition.

Whilst the acrylic binder performed satisfactorily over a range of applications, it is found to have some shortcomings. Specifically if the temperature exceeds 200°C. by a significant amount i.e. 220 to 300°C. and higher, the acrylic can in fact start to melt which of course is unacceptable for foodstuff applications, but where the receptor material is to be used with foodstuff in which water is to be driven off from the surface adjacent to the receptor material, such as for example in the cooking of pizzas in a microwave oven, the acrylic binder performed satisfactorily. The acrylic material generally speaking is satisfactory for the microwave cooking of a moist product, or where the receptor materials has a relatively small content of microwave interactive particles or where the heating takes place over a relatively short period.

An alternative material has been found to be satisfactory, and such alternative material is a silicone modified polyester resin. One example of such a material is that sold by Tego Chemie Service G.m.b.H. under the Trademark SILIKOFTAL HTL2. Such a material is in fact normally used as an exterior coating for saucepans and the like. The curing of the SILIKOFTAL HTL2 can cause a difficulty in that it takes a long time to cure but with the use of a catalyst the cure time can be dramatically reduced. One suitable catalyst is amine functional methoxy silane. The use of such a catalyst enables the SILIKOFTAL to be cured at a temperature of 70°C. in a period of ten seconds, such curing being sufficient to enable sheets of the material to be stacked without fusing together, but of course the curing continues for some considerable time thereafter. The extend to which the material is cured is directly proportional to the heat resistance of the material.

A further form of binder which can be used is a urethane type binder suitable for use in foodstuff applications.

The final dielectric constant of the interactive material can be modified by the addition of P.T.F.E. (Poly Tetra Fluoro Ethylene or similar polymer) in that the addition of this material when graphite particles are used gives a higher dielectric constant and therefore a more rapid heating effect.

Where the binder material is not suitable for direct contact with foodstuff, that material can still be used, but it will be preferable to cover such receptor material with for example a greaseproof sheet or the like.

Where the cross-linking resin is used for the binder, as will be appreciated, heat is required in order to cure the resin after the application of same to the receiving surface.

The particles may comprise one or any combination of the following: metallic particles such as aluminium, copper, gold, tin, zinc particles; metallic oxide particles such as barium dodecairon nonadecaoxide, diiron nickel tetra-oxide, manganese di-iron oxide, zinc di=iron oxide, carbon particles such as natural and synthetic graphite particles, and carbon black particles.

The particles are preferably in the size range from submicron up to 10 $\mu$.

Tests have shown that graphite particles provide an excellent and highly active receptive material.

It has been found that by controlling the amount of microwave interactive particles in the composition, control of the receptor activity can be effected.

The ratio of the amount of interactive particles to the liquid component of the composition may vary widely.

The composition may be applied over the receiving surface in one layer or in several layers each applied before or after the previous layer dries. It may be applied as a continuous layer or it may be applied only on discrete areas. By such means, in the case where the composition is applied only on discrete areas of the receiving surface, when the resulting receiving surface and interactive areas are used in connection with the microwave cooking of foodstuff, a pattern of crisped or browned areas, for example to create a waffle effect which may in some cases be desirable, may be created on the foodstuff.

In yet a further arrangement, different layers of the composition are applied to the receiving surface, when application of the composition takes place in a manner of steps, and said layers may comprise alternately continuous and dis-continuous layers so that in certain areas the thickness of the interactive material will be greater in some areas than in others. This arrangement also leads to the effect as described above wherein local hot spots are created in the receptor material when subjected to microwave heating, such hot spots being where the reactive material is thicker than in the other areas.

Where the composition is to remain with the receiving surface, for example after curing the binder where a binder is employed, the dried composition may be overcoated by means of a protective layer. The protective layer may be applied as a film, or preferably as a liquid formulation, such liquid formulation also being applied by printing according to any of the methods referred to herein.

Such protective layer preferably is a heat curable varnish which is cured by heat after application. This protective layer provides an isolation layer in order to separate the interactive particles from the foodstuff. This is important in many cases, because it will be unacceptable from a health and toxicity point of view for the particles to be in contact with the foodstuff. The application of a varnish for this purpose will have some effect upon the performance of the interactive particles during microwave heating, and care should be taken to ensure that the resulting laminate of interactive particles and protective layer still achieves the high degree of heat up which is necessary for the browning of the foodstuff in contact therewith.

The protective varnish layer may comprise suitably a silicone composition or solution or may be neat silicone, as silicone does provide a surface with a release characteristic i.e. a characteristic which is such that surfaces in contact therewith do not tend to become anchored thereto. The varnish however in its turn can act as a means of anchoring the distributed particles to the receiving surface and it should be noted therefore that in some embodiments of the invention it is not necessary that the particles should be distributed by means of a liquid component having a binder therein. The liquid component may for example be water which is simply used for obtaining the distribution of the interactive particles, the covering varnish serving finally to anchor the particles in the distributed position. Also, where the binder resin is not present, P.T.F.E. powder may be included to give faster heating of the final interactive layer. The covering varnish is required in such circumstances.

The use of a protective varnish is particularly suitable when the particles are of carbon material or graphite, as the protective layer prevents the transfer of the carbon or graphite particles to the foodstuff or to the fingers.

When carbon or graphite is used as all of or part of the interactive particles, it is desirable that the particles be not visible, as aesthetically such particles are unattractive. It is possible to conceal the carbon or graphite particles using a protective layer provided with a visual modifier therein, and one visual modifier which has been used with success comprises aluminum or similar particles. That is to say, the varnish is provided with aluminium particles therein so that when the varnish is applied over the interactive particles they become obscured by the aluminium particles. It is not necessary that aluminium particles be used, as other particles which obscure the interactive particles can be used. It has been found that only a relatively small amount of the visually modifying particles need be added and mixed with the varnish until such times as the varnish assumes a colour which will mask the interactive particles. Indeed visually modifying particles can be used in the composition which includes the interactive particles.

The utilisation of aluminium particles as a visual modifier has in fact revealed that the aluminium has a modifying effect not only on the appearance, but also on the activity of the interactive particles. Therefore, by controlling the amount of aluminium particles in the varnish and/or the composition, there can be exercised control on the rate of heating up of the interactive particles, which is highly desirable.

A specific protective layer formulation which has been utilised and which has been found to function satisfactorily is as follows:

100 parts by weight Dow Corning 7144 Silicone coating (SYL-OFF)
4 parts by weight 7048
coating (SYL-OFF)
10 parts by weight aluminium powder In the majority of cases, the receiving surface will be a permanent support for the interactive particles, but the invention also includes the case where the receiving surface forms only a temporary support for the Interactive particles. For example, when the particles have been laid down on the receiving surface it may be possible to transfer a layer containing the interactive particles from the receiving surface on to another surface, for example defined by a synthetics plastic film, which in turn is subsequently laminated to a final receiving surface. The eventual surface on which the interactive particles are permanently positioned preferably will comprise a sheet for insertion in or for forming part of a receptacle for foodstuff.

In one example where the interactive particles are transferred from the first receiving surface any of several methods may be adopted. In a first method, the composition is applied to the first receiving surface and the liquid component is dried. At this time the protective layer may be applied over the interactive particles, and the protective layer and interactive particles transferred from the first receiving surface to a support, and then a further receiving surface applied to the opposite side of the interactive particles from the said protective layer. In a second arrangement, after drying of the composition, the particles are transferred by heat to a secondary receiving surface, and subsequently the particles whilst on the secondary receiving surface are covered by a protective layer.

In a further arrangement, the particles, after the composition has been applied on the first receiving surface and dried, are transferred to a temporary support and are then transferred to a second receiving surface, following which they are covered by means of a protective layer.

Any material which is to come into contact with foodstuff must be carefully selected to ensure that there will be no toxicity problem. For example, when the silicone varnish is to come into contact with the foodstuff, it is preferable that it should be solvent free. If the material does not have to come into contact with foodstuff then the protective layer can be selected from a much greater range of materials including phenolic resins, polyester and epoxy resins.

The receiving surface on which the composition is received may be any suitable and may include paper board, paper, film plastic sheet and plastics articles such as thermoformed trays in which food products are to be held. The receiving surface may be for insertion in or form part of a package for foodstuff, and where the receptor material is such that it is required not to come into contact with the food, it may be covered by an isolating layer such as a greaseproof waxed paper. The receiptor material may be a wrapping material for the wrapping of foodstuff and it may be provided with apertures for areas allowing the passage of microwaves therethrough, so that the microwaves in addition to heating the receptor material can also pass to the foodstuff contained inside the wrapping.

By printing the composition directly on to the receiving surface, the cost of the receptor material is much reduced compared to the vacuum metalised film, as described in the said British Pat. No. 2,046,060B, and in addition by using a printing technique, the material can be laid down exactly where required so that there is no waste. Also, instead of printing a continuous area of the receptor material it may be laid down in a pattern for the creation of a cooked pattern to be created on the foodstuff which is adjacent the receptor material when the package and food stuff are placed in a microwave oven and subjected to microwave radiation. The pattern may be any suitable such as a grid pattern, or a pattern of symbols, monograms or the like.

When the receptor material is in the form of a wrapping for foodstuff, the foodstuff may be wrapped in the material when originally packaged, and may be sold in such material for placement directly into a microwave oven.

The application of the composition and coating although preferably applied by printing, may be applied by other methods, such as by using a roller, an air knife, meyerbar trailing blade, curtain or dip coating or other suitable methods of controlled weight application, and the composition and protective coating may be laid down in a number of coats.

The particle size of the interactive particles in the receptor material according to the invention may be generally the same as but will normally be greater than those described in the said British Pat. No. 2,046,060B. The present invention has as its object to produce a receptor material which will perform essentially in the same manner as the receptor material described in the said British Patent. The interactive particles present in the receptor material should be such as to ensure that the receptor material will heat up to the required extend in the required time when subjected to microwave radiation.

It is also within the present invention the possibility to provide an indication of when the receptor material reaches the desired temperature. The composition and/or protective layer may embody materials which change colour when heated to a certain degree. These materials are referred to a s thermo-chromic pigments and are useful for indicating the temperature to which the receptor material has reached. In an alternative arrangement, a strip could be embodied in the receptor material which comprises a layer of a wax or chalk formulation which changes colour when subjected to heating to a predetermined degree and the change in colour exposes an underlayer of a different colour from the said formulation so that visually there is an indication of the temperature which the receptor material has reached.

I claim:

1. A method of producing a microwave interactive sheet material for use in microwave cooking comprising the steps of:

(a) providing a receiving sheet;

(b) applying to a surface of the receiving sheet a composition comprising a liquid component in which are mixed in suspension microwave interactive particles in an amount not greater than 50% of said composition so as to distribute the composition over the surface; and (c) drying the liquid component of the composition to leave the particles so distributed so as to fix the particles in such distribution and so as to ensure that the particles form a layer to be subjected to microwave radiation, whereby upon drying of the liquid component, the amount of particles is sufficient to provide cooking of foodstuff placed in close proximity thereto,

2. A method according to claim 1, wherein the receiving sheet comprises a sheet of cardboard material or a synthetic plastics material.

3. A method according to claim 1 or 2, wherein the receiving surface comprises the surface or part of the surface of a receptacle which is for containing foodstuff to be cooked in a microwave oven, the arrangement being that when the receptacle contains the foodstuff, such foodstuff is adjacent said receiving surface.

4. A method according to claim 1, including the step of stirring the composition prior to the application of same to the receiving surface.

5. A method according to claim 1, including the step of applying the composition to the receiving surface by means of a printing step.

6. A method according to claim 5, wherein the printing step comprises gravure, roller coating, litho letterpress or silk screen printing.

7. A method according to claim 1 wherein said composition comprises as a major part of the liquid component, a cross-linking synthetic resin.

8. A method according to claim 7 wherein the cross-linking resin is dried by the application of heat.

9. A method according to claim 7 wherein the cross-linking resin is a silicone modified polyester resin.

10. A method according to claim 9, wherein the silicone modified polyester resin includes a catalyst to accelerate the curing thereof.

11. A method according to any of claim 7, wherein the said composition includes P.T.F.E. particles.

12. A method according to claim 1, wherein the particles comprise one or any combination of the following:

metallic particles such as aluminium, copper, gold, tin, zinc particles;

metallic oxide particles such as barium dodecairon nonadecaoxide, di-iron nickel tetra oxide, manganese di-iron oxide, zinc di-iron oxide, carbon particles such as natural and synthetic graphite particles, and carbon black particles.

13. A method according to claim 1, wherein the particles are of a size in the range from submicron up to 10 $\mu$.

14. A method according to claim 1, wherein the liquid component and particles are contained in the composition in the ratio range 1:1 to 9:9 inclusive.

15. A method according to claim 1, including the step of applying the composition repeatedly to build up the thickness of same on the receiving surface.

16. A method according to claim 1 including the step of applying the composition only on discrete areas of the receiving surface.

17. A method according to claim 1, including repeating steps (b) and (c) to build up the thickness thereof on the receiving surface and in some but not all of said steps applying the composition only on discrete areas of the receiving surface to make the thickness of the composition in such areas thicker than elsewhere on said receiving surface.

18. A method according to claim 1, including the step of applying a protective layer over the distributed particles interactive layer after the drying of the liquid component of the composition.

19. A method according to claim 18, wherein the protective layer is applied a a liquid formulation over the particulate interactive layer.

20. A method according to claim 19, wherein the protective layer is applied by printing.

21. A method according to claim 20, wherein the printing of the protective layer is by gravure, roller coating, litho letter press or silk screening.

22. A method according to claim 19, wherein the protective layer is a heat curable varnish which is cured by heat after application.

23. A method according to claim 19, wherein the protective layer liquid formulation includes visually modifying particles so that when the protective layer is applied over the interactive layer, the interactive layer is obscured or modified in appearance.

24. A method according to claim 23, wherein the visually modifying particles are aluminium particles.

25. A method according to claim 24, wherein the protective layer formulation comprises:
100 parts by weight Dow Corning 7144 Silicone coating (SYL-OFF)
4 parts by weight 7048 coating (SYL-OFF)
10 parts by weight aluminium powder

26. A method according to claim 18, wherein the protective layer is a synthetic plastics material film which is laminated to the interactive layer.

27. A method according to claim 1 wherein the receiving surface is a temporary support for the interactive material and is transferred therefrom to a second support surface.

28. A method according to claim 27, wherein said second support surface comprises a sheet of cardboard or plastics material.

29. A method according to claim 28, wherein said sheet of cardboard or plastics material comprises or forms part of a receptacle which is for receiving foodstuff and which is suitable for placement in a microwave oven.

30. A method according to claim 27, wherein the interactive layer is transferred after drying of the liquid component and by a heat transfer laminating step.

31. A method according to claim 27, wherein the interactive layer after transfer to the second support surface, is covered by means of a protective layer.

* * * * *